US011919065B2

(12) United States Patent
Suzuki et al.

(10) Patent No.: US 11,919,065 B2
(45) Date of Patent: Mar. 5, 2024

(54) METHOD FOR PRODUCING HOT-FORGED MATERIAL

(71) Applicant: PROTERIAL, LTD., Tokyo (JP)

(72) Inventors: Shogo Suzuki, Tokyo (JP); Tomonori Ueno, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 374 days.

(21) Appl. No.: 16/468,937

(22) PCT Filed: Dec. 21, 2017

(86) PCT No.: PCT/JP2017/045961
§ 371 (c)(1),
(2) Date: Jun. 12, 2019

(87) PCT Pub. No.: WO2018/117226
PCT Pub. Date: Jun. 28, 2018

(65) Prior Publication Data
US 2020/0094309 A1 Mar. 26, 2020

(30) Foreign Application Priority Data
Dec. 21, 2016 (JP) ..... 2016-247524

(51) Int. Cl.
*B21J 13/02* (2006.01)
*B21J 3/00* (2006.01)
*C22C 19/05* (2006.01)

(52) U.S. Cl.
CPC ..... *B21J 13/02* (2013.01); *B21J 3/00* (2013.01); *C22C 19/057* (2013.01)

(58) Field of Classification Search
CPC ..... B21J 13/02; B21J 13/00
(Continued)

(56) References Cited

U.S. PATENT DOCUMENTS 2,926,138 A 2/1960 Huet
3,140,779 A * 7/1964 Dalton ..... B21C 23/32 72/42

(Continued)

FOREIGN PATENT DOCUMENTS

DE 102009038179 A1 * 5/2010 ..... C10M 169/00
EP 0003419 8/1979

(Continued)

OTHER PUBLICATIONS

English translation of the International Search Report corresponding to International Patent Application No. PCT/JP2017/045961 (1 page) (dated Apr. 3, 2018).

(Continued)

*Primary Examiner* — Debra M Sullivan
*Assistant Examiner* — Matthew Stephens
(74) *Attorney, Agent, or Firm* — Myers Bigel, P.A.

(57) ABSTRACT

Described herein are methods for producing a hot forged material in air using a Ni-based superalloy for the die. Also described herein are methods for producing a hot forged material, by placing on a lower die a material for hot forging, of which part or all of the surface is coated with a glass-based lubricant, and pressing the material for hot forging with the lower die and an upper die, to form a hot forged material, wherein one or both of the lower die and the upper die are made of a Ni-based superalloy, and wherein the surface of the die in contact with the material for hot forging (Continued)

is coated with a glass-based lubricant containing $SiO_2$ as a main component, in which the total content of alkali metal oxides is 0 to 10.0% in mass %.

10 Claims, 3 Drawing Sheets

(58) Field of Classification Search
USPC ..... 72/462; 76/107.1
See application file for complete search history.

(56) References Cited

U.S. PATENT DOCUMENTS 3,181,324 A * 5/1965 Labino ..... B21C 23/32 29/423
3,635,068 A * 1/1972 Watmough ..... B21J 5/00 72/342
4,096,076 A 6/1978 Spiegelberg
4,154,075 A 5/1979 Spiegelberg
4,183,236 A * 1/1980 Spiegelberg ..... B21J 3/00 72/42
4,212,189 A * 7/1980 Fuchs ..... B21K 5/20 72/478
4,740,354 A * 4/1988 Waranabe ..... C22C 19/03 420/455
4,788,842 A * 12/1988 Kopp ..... B21J 3/00 72/45
4,802,934 A * 2/1989 Ohno ..... C22C 19/05 148/404
5,242,506 A * 9/1993 Barber ..... C10M 111/04 508/141
6,330,818 B1 * 12/2001 Jain ..... B21J 3/00 72/43
2009/0133462 A1 * 5/2009 Cairo ..... B21J 13/025 72/374
2011/0302979 A1 * 12/2011 Oppenheimer ..... B21C 23/32 72/42
2017/0283926 A1 * 10/2017 Aoki ..... C22C 19/051 148/404

FOREIGN PATENT DOCUMENTS

EP 2703454 3/2014
JP S60221542 11/1985
JP S6250429 3/1987
JP S6250429 A * 3/1987 ..... C22C 19/03
JP S62116748 5/1987
JP S6321737 5/1988
JP H06254648 9/1994
JP H10330776 12/1998
JP H1192169 4/1999
JP 2015091596 A * 5/2015 ..... B21J 13/02
JP 2016069703 5/2016
WO 8701395 3/1987
WO 9207050 4/1992
WO 2016052523 4/2016

OTHER PUBLICATIONS

Extended European Search Report corresponding to European Patent Application No. 17884395.9 (6 pages) (dated Jul. 31, 2020).
Machine translation of the Notice of Reasons for Refusal issued for Japanese Patent Application No. 2018-558073 (4 pages) (dated Sep. 6, 2019).

* cited by examiner

METHOD FOR PRODUCING HOT-FORGED MATERIAL

TECHNICAL FIELD

The present invention relates to a method for producing a hot forged material using a glass-based lubricant.

BACKGROUND ART

In the forging of a product consisting of a heat-resistant alloy, the forging material is heated to a predetermined temperature to improve workability. Since heat-resistant alloys have high strength even at high temperatures, high mechanical strength is required for the hot forging die used for forging them. In addition, when the temperature of the hot forging die is lower than that of the forging material, since the workability of the forging material will decrease due to die chilling, a product consisting of a poor workability material such as Alloy 718 or Ti alloy is forged using the hot forging die which is heated to a high temperature same to or close to that of the forging material. Therefore, the hot forging die should have high mechanical strength at high temperatures. A Ni-based superalloy usable in hot forging in which the die temperature in air is 1000° C. or higher has been proposed as hot forging dies satisfying this requirement (see, for example, Patent Documents 1 to 3).

Moreover, since the forging material and the die come into contact at high temperature and under high stress load in hot forging, a lubricant or a releasing agent is used to reduce the forming load and prevent seizing due to diffusion bonding of the die and forging material. In hot forging with a die temperature of 1000° C. or more in air, a method for hot forging using a graphite-based lubricant or a boron nitride-based releasing agent has been proposed (Patent Document 4).

The hot forging referred to in the present invention includes hot die forging, in which the temperature of the hot forging die is raised to near the temperature of the forging material, and isothermal forging in which the temperature of the hot forging die is raised to the same temperature as that of the forging material.

REFERENCE DOCUMENT LIST

Patent Document

Patent Document
1: JP S62-50429 A
Patent Document 2: JP S63-21737 B
Patent Document 3: U.S. Pat. No. 4,740,354 A
Patent Document 4: JP H06-254648 A

SUMMARY OF THE INVENTION

Problem to be Solved by the Invention

According to Patent Document 4, hot forging in air using a Ni-based superalloy at a high temperature of about 1100° C. for the die and using a glass-based lubricant is disadvantageous in terms of service life, since it causes a chemical reaction promoting oxidative corrosion between the glass and the die. Therefore, Patent Document 4 mentions a graphite-based lubricant and a boron nitride-based releasing agent which hardly cause any chemical reaction as a lubricant or a releasing agent applicable to hot forging. Although this invention is advantageous in terms of the service life of the die, a method for hot forging using a glass-based lubricant as a lubricant and a releasing agent is desirable from the viewpoint of reducing the forming load. For example, in order to obtain a large-sized hot forged material, using a glass-based lubricant is more advantageous from the viewpoint of reducing the forging load and preventing shape defects. However, in reality, there are no proposals in which a glass-based lubricant can be used and that can prevent or reduce oxidative corrosion.

The object of the present invention is to provide a method for producing a hot forged material, using a Ni-based superalloy for the die, which is advantageous in terms of the service life of the die, as well as using a glass-based lubricant for reducing the forging load, and wherein a chemical reaction promoting oxidative corrosion hardly occurs in the lubricant even when hot forging in air.

Means for Solving the Problem

The present inventors examined the chemical reaction promoting oxidative corrosion on a die made of a Ni-based superalloy by a glass-based lubricant coated on the surface of a material for hot forging, and found that the chemical reaction is caused by volatile substances containing alkali metal components such as alkali borate salts volatilizing from the surface of the molten glass and reacting with the material, and thereby achieved the present invention.

That is, the present invention is a method for producing a hot forged material, by placing on a lower die a material for hot forging, wherein part or all of the surface of the material for hot forging is coated with a glass-based lubricant, and pressing the material for hot forging with the lower die and an upper die, to form a hot forged material, wherein one or both of the lower die and the upper die are made of a Ni-based superalloy, the surface of the die made of the Ni-based superalloy in contact with the material for hot forging is coated with a glass-based lubricant containing $SiO_2$ as a main component, and the total content of alkali metal oxides in the glass-based lubricant is 0 to 10.0% in mass %.

It is a method for producing a hot forged material, wherein a preferable composition of the Ni-based superalloy consists of, in mass %, W: 7.0 to 12.0%, Mo: 4.0 to 11.0%, Al: 5.0 to 7.5%, optionally Cr: 7.5% or less, optionally Ta: 7.0% or less, optionally one or more elements selected from the group of Hf, Zr, La, Y and Mg: 0.5% or less, and the balance of Ni with inevitable impurities.

Effects of the Invention

According to the present invention, hot forging in air, using a Ni-based superalloy for the die, which is advantageous in terms of the service life of the die, and using a glass-based lubricant wherein a chemical reaction promoting oxidative corrosion hardly occurs in the lubricant, can be performed.

MODE FOR CARRYING OUT THE INVENTION

Figure 1:
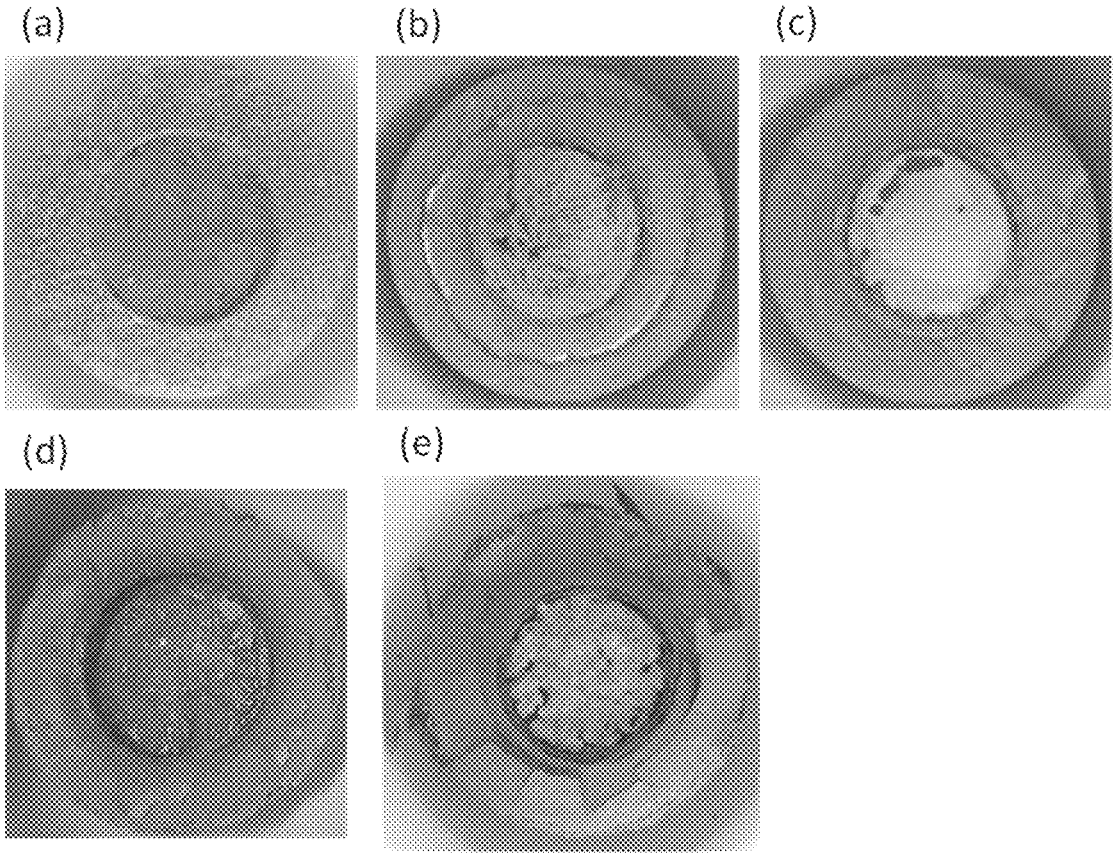
FIG. 1 shows photographs of high temperature corrosion by the glass-based lubricant.

Hereinafter, the present invention will be described in detail. The glass-based lubricant coating the material for hot forging is referred to as "glass-based lubricant A", and the glass-based lubricant coating the die that is a lower die or an upper die is referred to as "glass-based lubricant B".

First, a material for hot forging (rough forging) is provided. The present invention is directed to materials for hot forging, wherein part or all of the surface of the material for hot forging is coated with the glass-based lubricant A. Typical materials that need to be coated with the glass-based lubricant A are poor workability materials such as Ni-based superalloys containing Ni as the main component and Ti alloys. Furthermore, the forging is not a small one, which can be continuously pressed, but a large one that mainly requires a forging load of several thousand tons to several tens of thousands tons.

The material for hot forging mentioned above is heated to a hot forging temperature, placed on a lower die using a manipulator or the like, and pressed by the lower die and an upper die to form a hot forged material. Note that, since the material for hot forging used in the present invention as described above is a poor workability material, the die used for hot forging is a die made of a Ni-based superalloy for the reason described later. The die is used for one or both of the upper die and the lower die. If using either one of them, the lower die on which the material for hot forging is placed is best, and preferably, a die made of a Ni-based superalloy is used for both the upper die and the lower die.

In addition, as a die to be used, it is preferable to use the present invention rather than one in which a die impression surface is formed on the working surface that dies the material for hot forging, and that dies into a turbine blade or a disk shape. This is because, when oxidative corrosion occurs on a die having a die impression surface, the shape of the die impression surface is gradually lost. Using the present invention is effective to prevent this.

The material of the hot forging die in the present invention will be described. In hot forging of a product consisting of a poor workability material such as a Ni-based superalloy or a Ti alloy, the die used after heating to a high temperature must have high mechanical strength at that temperature. Therefore, examples of candidates for the die material include Ni-based superalloys, fine ceramics and Mo-based alloys. However, the use of fine ceramics has the problem of an increase in manufacturing cost due to high die cost, and similarly, the use of a Mo-based alloy also has the problem of an increase in manufacturing cost since it requires forging in an inert atmosphere. Therefore, as the die material, a Ni-based superalloy, which is inexpensive in die cost and, additionally, has relatively excellent oxidation resistance and high-temperature strength, and can therefore be used in air and at high temperatures, is suitable. Note that the Ni-based superalloy described in the present invention contains 50% or more by mass % of Ni as an essential component, and furthermore, is an austenitic heat-resistant alloy that contains additive elements such as Al, W, Mo and Cr, for example, with the kind and amount depending on the purpose. In addition, examples of the forging material hot-forged using the die include a columnar Ni-based superalloy, but in the present invention, the shape and material of the forging material are not limited.

Among Ni-based superalloys, Ni-based superalloys having the alloy composition described below have excellent high-temperature compressive strength and are preferable as a die material for hot forging such as isothermal forging and hot die forging in air. On the other hand, the Ni-based superalloy having the following composition is further coated with a glass-based lubricant B described later, due to significant oxidative corrosion. Note that the units of the composition described below are all in mass %.

W: 7.0 to 12.0%

W forms a solid solution in an austenite matrix, and also forms a solid solution in a gamma prime phase having $Ni_3Al$, which is a precipitation strengthening phase, as a basic type, to enhance the high temperature strength of the alloy. On the other hand, W also has the effect of reducing the oxidation resistance, and if it exceeds 12.0%, cracks are more likely to occur. From the viewpoint of increasing the high temperature strength, suppressing the reduction in oxidation resistance, and suppressing the occurrence of cracks, the content of W in the Ni-based superalloy of the present invention is set to 7.0 to 12.0%. The preferable lower limit to obtain the effect of W more reliably is 10.0%, and further preferably 10.3%.

The preferable upper limit of W is 11.0%, and further preferably 10.7%.

Mo: 4.0 to 11.0%

Mo forms a solid solution in an austenite matrix and also forms a solid solution in a gamma prime phase having $Ni_3Al$, which is a precipitation strengthening phase, as a basic type, to enhance the high temperature strength of the alloy. On the other hand, Mo has the effect of reducing the oxidation resistance. From the viewpoint of increasing the high temperature strength and suppressing the reduction in oxidation resistance, the content of Mo in the Ni-based superalloy of the present invention is set to 4.0 to 11.0%. The preferable lower limit to obtain the effect of Mo more reliably is 7.0%, further preferably 9.0%, and further preferably 9.8%. Moreover, the preferable upper limit of Mo is 10.5%, and further preferably 10.2%.

Al: 5.0 to 7.5%

Al has the effect of precipitating the gamma prime phase consisting of $Ni_3Al$ by bonding with Ni, increasing the high temperature strength of the alloy, forming an alumina film on the surface of the alloy, and imparting oxidation resistance to the alloy. On the other hand, when the content of Al is too high, it also has the effect of generating the eutectic gamma prime phase excessively and also of lowering the high temperature strength of the alloy. From the viewpoint of increasing the oxidation resistance and high temperature strength, the content of Al in the Ni-based superalloy of the present invention is set to 5.0 to 7.5 mass %. The preferable lower limit to obtain the effect of Al more reliably is 5.5%, further preferably 5.8%, further preferably 6.0%, and more preferably 6.1%. Moreover, the preferable upper limit of Al is 6.8%, further preferably 6.5%, and more preferably 6.4%.

In the present invention, the following elements can be optionally contained in addition to the elements described above. The lower limit of the optional elements is 0%.

Cr: 7.5% or Less

The above-described Ni-based superalloy can contain Cr. Cr has the effect of improving the corrosion resistance of the alloy, and also improving the oxidation resistance of the alloy by promoting the formation of a continuous layer of alumina on or in the alloy. On the other hand, when the content of Cr is too large, there is also an effect of facilitating the precipitation of harmful phases such as a TCP (Topologically Close Packed) phase. By reducing the content of W or Mo, the precipitation of harmful phases such as a TCP phase can be suppressed even when the content of Cr is large, but when the content of W or Mo, which are solid solution strengthening elements, is reduced, the high temperature strength of the alloy decreases, therefore it is not preferable to excessively reduce the content of these elements. From the viewpoint of increasing corrosion resistance and oxidation resistance and suppressing the precipitation of harmful phases without excessively reducing the content of W or Mo, the upper limit of the addition amount of Cr in the present invention is set to 7.5%. In order to sufficiently exhibit the effect of Cr, it is preferable to contain 1.0% or more.

Ta: 7.0% or Less

The above-described Ni-based superalloy can contain Ta. Ta increases the high temperature strength of the alloy by forming a solid solution by substituting the Al sites in the gamma prime phase consisting of $Ni_3Al$. Furthermore, it has the effect of increasing the adhesion of the oxide film formed on the alloy surface and improving the oxidation resistance of the alloy. On the other hand, when the content of Ta is too large, there is also an effect of facilitating the precipitation of harmful phases such as a TCP phase. From the viewpoint of increasing oxidation resistance and high temperature strength and suppressing the precipitation of harmful phases, the upper limit of the content of Ta in the present invention is set to 7.0%. In order to sufficiently exhibit the effect of Ta, it is preferable to contain 3.0% or more.

One or More Selected from the Group of Hf, Zr, La, Y and Mg: 0.5% or Less

The above-described Ni-based superalloy can contain one or more elements selected from Hf, Zr, La, Y and Mg. These elements have the effect of increasing the adhesion of the oxide film formed cu the alloy surface and improving the oxidation resistance of the alloy. On the other hand, when the addition amount of these elements is too large, it also has an effect of excessively forming intermetallic compounds with Ni or the like and of reducing the ductility of the alloy. From the viewpoint of increasing the oxidation resistance and suppressing the decrease in ductility, the upper limit of the total value of the contents of these elements in the present invention is set to 0.5%. In order to sufficiently exhibit the effect of the addition of Hf, Zr, La and Y, it is preferable to contain 0.1% or more. The content of Mg may be 0.0001% or more, but 0.0020% or more is preferable to reliably exhibit the effect of Mg addition.

The Ni-based superalloy in the present invention basically contains Al, W, and Mo as the essential components, and as necessary, the optional elements mentioned above, and the balance excluding the inevitable impurities is composed of Ni. In the Ni-based superalloy of the present invention, Ni is the main element constituting the gamma phase, and also constitutes the gamma prime phase together with Al, Mo and W.

The Ni-based superalloy of the present invention can contain components other than Ni, Mo, W and Al as inevitable impurities.

Next, the glass-based lubricant B used on the surface of the die made of Ni-based superalloy in the present invention will be described. In the hot forging of a product consisting of a heat-resistant alloy having high strength even at high temperature, the forging load (forming load) required for forging is high, and a lubricant is used to reduce the forging load. In addition, in hot forging using a die made of Ni-based superalloy at a high temperature of 1000° C. or higher, it is desirable that the lubricant also function as a releasing agent, since seizing of the forging material and the die easily occurs. Therefore, a glass-based lubricant providing a lower shear friction factor than a graphite-based Lubricant, having a high forming load reduction effect and functioning as a releasing agent, is suitable as the glass-based lubricant B used for the surface of the die. Note that the glass-based lubricant described herein refers to a single glass frit which is a powder obtained by pulverizing glass, or a mixture of a glass fit and a dispersant such as water.

It is preferable that the glass contained in this glass-based lubricant B be a glass consisting of an oxide with $SiO_2$ as the main component, that is excellent in heat resistance. Here, the main component means an oxide having the highest content by mass %. The lubricity by the glass-based lubricant B depends on the viscosity of the glass, and the lubricity can be adjusted through the viscosity. Therefore, $B_2O_3$, $Al_2O_3$, alkali metal oxides such as $Na_2O$, and alkali earth metal oxides such as CaO can be added to the oxide glass with $SiO_2$ as the main component used in the present invention, in the kind and amount according to the purpose, both for adjusting to an appropriate viscosity and improving the chemical stability. If the addition amount of oxides other than $SiO_2$ is too large, the heat resistance decreases and crystallization occurs, therefore, it is preferable that the total value of the addition amount be 50% or less. Moreover, in the present invention, the total content of the alkali metal oxides among the oxides other than $SiO_2$ is set to 10.0% or less for the reasons described later. Note that this 10.0% or less prescribed in the present invention is the mass % when the total amount of single glass units contained in the glass-based lubricant is set to 100%. The composition of the glass-based lubricant A is not particularly limited.

The inventors studied the chemical reaction that promotes oxidative corrosion by the glass-based lubricant, and reached the following conclusion that it is necessary to limit the total content of alkali metal oxides from the viewpoint of the die service life. When an alkali metal oxide is contained in the glass, the alkali metal components contained in the glass are evaporated from the surface of the heated and melted glass as borate alkali salts, single alkali metals or the like. These evaporated substances cause a very violent reaction promoting oxidative corrosion on the surface of the die. This reaction causes wear of the die due to the formation of corrosive substances on the die surface on the air side as viewed from the three-phase interface consisting of the molten glass, the die and the air. In addition, although erosion of the die surface due to the alkali metal components in the glass occurs even on the two-phase interface between the molten glass and the die, this reaction is relatively mild and does not cause any problem in terms of the die service life. That is, there is a risk of formation of the three-phase interface due to partial breakage of the lubricating film of the glass on the die surface after forging, and in hot forging in which the die surface is exposed to high temperatures of 1000° C. or more for a long time in air in order to continuously forge the material, the reduction of the die service life associated with the wear of the die caused by the alkali metal components in the glass is a critical issue. In addition, when a Ni-based superalloy, which has a high strength at high-temperatures and can be used for hot forging at a die temperature of 1000° C. or more, is used for the die, the Cr content of this alloy being relatively low, the issue mentioned above becomes highly critical. Therefore, it is preferable that the content of the alkali metal oxides of the glass be low, and the content in the present invention be set to 0 to 10.0% from the viewpoint of service life. The preferable upper limit of the content in order to more reliably obtain the effect of suppressing the wear of the die is 7.0%, further preferably 3.0%, and more preferably 1.0%.

The glass-based lubricant B described above is supplied to the surface of the die in contact with the material for hot forging by, for example, spraying or brush coating the die surface. Among these, the application by spraying is most preferable as an application method from the viewpoint of controlling the thickness of the lubricating film.

It is preferable that the thickness of the glass-based lubricant B by coating be 100 μm or more in order to form a continuous lubricating film during forging. If it is less than 100 μm, the lubricating film may be partially damaged, and wear and seizing of the die may occur more easily, in addition to the deterioration of the lubricity due to the direct contact between the material for hot forging and the die. On the other hand, even if the thickness of the glass-based lubricant B is excessively thickened, the effect may become saturated, or in the case of forging using a die having a complicatedly shaped die impression surface, deviation from the dimensional tolerance of the forgings may occur due to deposition on the die impression surface of the glass. Therefore, it is preferable that the thickness of the lubricating film be 500 μm or less.

EXAMPLES

Example 1

The present invention is further described in detail by the following examples. An ingot of the Ni-based superalloy shown in Table 1 was produced by vacuum melting. The units are in mass %. Note that P, S, N and O contained in the following ingot are each 0.003% or less, and C, Si, Mn, Co, Ti, Nb and Fe are each 0.03% or less. In No. B, Mg was selected as an element selected from the group of Hf, Zr, La, Y and Mg, and its content was 0.0001%.

These alloys having the compositions showy in Table 1 have the characteristics of excellent high temperature compressive strength as shown in Table 2 and have sufficient characteristics as a hot forging die. Note that the high temperature compressive strength (compressive yield strength) was performed at 1100° C.

TABLE 1

(unit: mass %)

| No. | W | Mo | Al | Cr | Ta | Balance |
|---|---|---|---|---|---|---|
| A | 10.5 | 10.0 | 6.3 | — | — | Ni and inevitable impurities |
| B | 10.0 | 10.6 | 6.2 | 1.5 | 3.1 | Ni and inevitable impurities |

* The "—" means that the element was not added.

TABLE 2

| Strain rate | Compressive Yield Strength (MPa) | |
|---|---|---|
| (1/sec) | No. A | No. B |
| 0.001 | 460 | 489 |
| 0.01 | 570 | 507 |
| 0.1 | 580 | — |

* The "—" means that the test was not performed

A cylindrical test specimen having a diameter of 15 mm and a height of 5 mm was prepared by dividing and processing the ingot of No. A mentioned above. The entire surface of the test specimen had a polishing surface equivalent to No. 1000, and a recessed part with a diameter of 8.5 mm and a depth of 1 mm was formed on one of the bottom surfaces of the test specimen. About 50 mg of glass powder of each of the compositions shown in Table 3 was put as a glass powder constituting the glass-based lubricant in this recessed part to prepare the test specimens No. 1 to 3, 11, and 12. The glass composition shown in Table 3 is based on the results obtained by quantitative analysis of the powder of the glass-based lubricant dried at room temperature by emission spectrometry, and at the right end is shown the total value of the contents of the alkali metal oxides $Na_2O$ and $K_2O$ contained in these glasses for reference. Using this test specimen, the chemical reaction promoting oxidative corrosion by the glass-based lubricant was evaluated by heating in air with the recessed part facing up. This test simulates the state in which molten glass partially remains on the die surface when using the Ni-based superalloy mentioned above as a hot forging die.

TABLE 3

(unit: mass %)

| No | $SiO_2$ | $B_2O_3$ | $Al_2O_3$ | FeO | $TiO_2$ | CoO | $ZrO_2$ | $HfO_2$ | CaO | MgO | SrO | BaO | $Na_2O$ | $K_2O$ | $Na_2O + K_2O$ |
|---|---|---|---|---|---|---|---|---|---|---|---|---|---|---|---|
| 1 | 55.5 | 8.2 | 12.3 | 0.4 | 0.1 | 0.0 | 0.0 | 0.0 | 22.1 | 0.5 | 0.2 | 0.0 | 0.6 | 0.1 | 0.7 |
| 2 | 62.7 | 5.3 | 8.9 | 0.1 | 0.1 | 2.2 | 6.2 | 0.1 | 7.3 | 0.1 | 0.0 | 0.0 | 4.1 | 2.9 | 7.0 |
| 3 | 65.5 | 8.7 | 9.8 | 0.4 | 0.2 | 0.0 | 0.1 | 0.0 | 5.8 | 0.4 | 0.0 | 1.1 | 4.3 | 3.7 | 8.0 |
| 11 | 35.5 | 23.3 | 23.4 | 0.2 | 0.0 | 0.0 | 0.0 | 0.0 | 3.2 | 0.1 | 0.0 | 0.0 | 8.8 | 5.5 | 14.3 |
| 12 | 47.8 | 1.1 | 18.0 | 0.3 | 0.1 | 0.0 | 0.0 | 0.0 | 10.0 | 4.6 | 0.0 | 0.0 | 17.6 | 0.5 | 18.1 |

The test specimens of the present invention's Examples No. 1 to 3 and the Comparative Examples No. 11 and 12 were used to conduct a heating test that the test specimens were charged in a furnace heated to 1100° C. while being placed in a ceramic crucible consisting of $SiO_2$ and $Al_2O_3$, and were then removed from the furnace after maintaining at 1100° C. for 3 hours, and air cooling was carried out with the crucible covered with a lid of the same material immediately after removing it in order to prevent peeling of the scale out of the crucible.

In addition, for each test specimen, the mass measurement of the crucible with the test specimen inside was performed immediately before the heating test and immediately after the heating test. The mass change of the test specimens before and after the test was calculated by subtracting; the mass measured immediately before the heating test from the mass measured immediately after the test. As the value of the mass change increases, the chemical reaction by the glass-based lubricant becomes more violent, and the amount of wear of the die material (the amount of reaction by oxidative corrosion) increases. The mass change was calculated as follows. The unit of mass change is mg.

Mass change=Mass after test−Mass before test

FIG. 1A shows a picture of the appearance of the test specimen of the present invention's Example No. 1 taken from the top of the crucible with the lid removed after the heating test. FIG. 1B shows the appearance of the present invention's Example No. 2. FIG. 1C shows the appearance of the present invention's Example No. 3. FIG. 1D shows the appearance of Comparative Example No. 11. FIG. 1E shows the appearance of Comparative Example No. 12.

In Comparative Examples No. 11 and 12, which have a high content of alkali metal oxides, a very violent chemical reaction is occurring due to evaporation from the glass of a single alkali metal or of alkali borate containing an alkali metal component, from the periphery of the recessed part in the test specimen to the side of the test specimen. On the other hand, in the present invention's Examples No. 2 and 3, which have a relatively small content, the chemical reaction is occurring only in the periphery of the recessed part in the test specimen (near the three-phase interface consisting of the molten glass, the test specimen material and the air). Furthermore, in the present invention's Example No. 1, which hardly contains any alkali metal oxide, minor scale peeling is occurring due to oxidation around the recessed part, but the chemical reaction is not occurring even around the recessed part.

Figure 2:
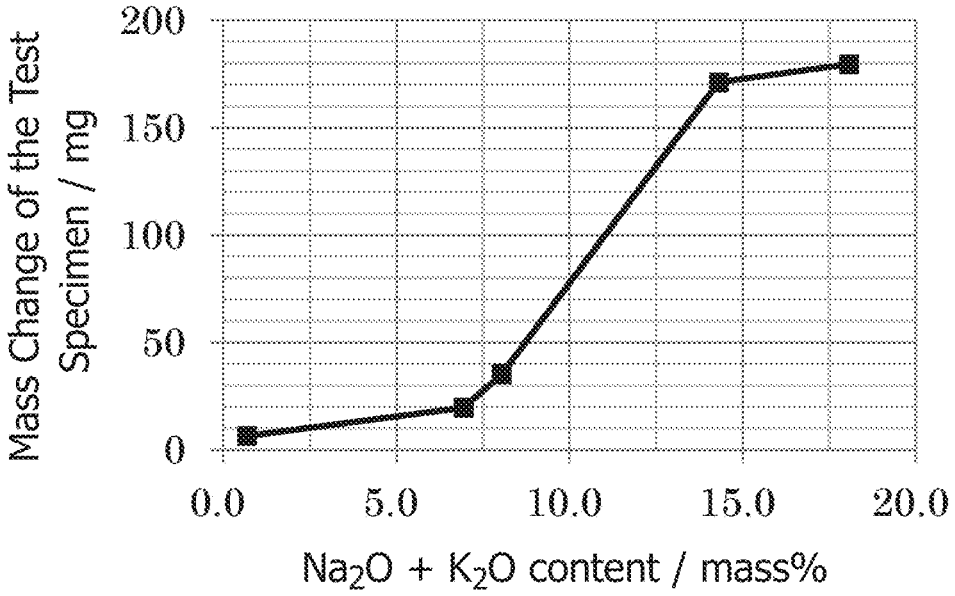
FIG. 2 is a drawing showing the relationship between the total value the content of alkali metal oxides contained in the glass of the glass-based lubricant and the mass increase associated with the formation of corrosive substances due to high temperature corrosion.

Table 4 shows the mass change of each test specimen calculated by the method mentioned above. Moreover, FIG. 2 shows the relationship of the mass change with the total content of the alkali metal oxides $Na_2O$ and $K_2O$ contained in glass in the present invention's Examples No. 1 to 3 and Comparative Examples No. 11 and 12. Note that the mass change by oxidation of the test specimen of the same shape without glass powder inside and heated under the same conditions is about 6.4 mg.

From Table 4 and FIG. 2, it can be seen that while the amount of wear of the die material due to the chemical reaction is large in Comparative Examples No. 11 and 12, which have a high content of alkali metal oxides, the wear is small in the present invention Examples No. 2 and 3, and furthermore, the mass change in the present invention's Example No. 1 is almost the same as the value due to oxidation, and almost no wear of the die material due to the chemical reaction is occurring in the present invention Example No. 1.

TABLE 4

(unit: mg)

| No | Mass Change |
|---|---|
| 1 | 6.5 |
| 2 | 19.7 |
| 3 | 35.3 |
| 11 | 171.2 |
| 12 | 179.5 |

Example 2

Next, a rectangular parallelepiped test specimen having a width of 10 mm, a length of 20 mm and a height of 5 min was prepared by dividing and processing the ingots of No. A and No. B from Table 1. The test specimen has a polishing surface equivalent to No. 1000 on the entire surface. In the vicinity of the center of one half of the 20 mm×10 mm face of this test specimen, a test specimen coated with about 20 mg of a slurry-like glass-based lubricant with glass powder of the composition of No. 2 shown in Table 3 so that its thickness be about 500 μm, was prepared. The combination of the ingot of the prepared test specimen and the glass-based lubricant is shown in Table 5.

TABLE 5

| No | Ingot | Glass-based Lubricant |
|---|---|---|
| 4 | No. A | Composition of No. 2 in Table 3 |
| 5 | No. B | Composition of No. 2 in Table 3 |

Using the test specimen coated with about 20 mg of the glass-based lubricant described above, the corrosion depth due to the glass-based lubricant was evaluated by heating the specimen air with the surface coated with the glass-based lubricant facing up, cutting the test specimen to make it 5 mm wide, 20 mm long and 5 mm high after heating, performing hot embedding and polishing so that the cut surface become the observation surface, and observing the polished cut surface.

The test specimen was heated by placing the test specimen as it is in a furnace heated to 1100° C., maintaining it at 1100° C. for 1 hour, and then removing it from the furnace. This test is to evaluate the actual corrosion depth by the molten glass partially remaining on the die surface when the Ni-based superalloy mentioned above is used as a hot forging die. Note that, since the dispersant such as water contained in the glass-based lubricant evaporates during heating, the dispersant does not affect the corrosion depth.

Figure 3:
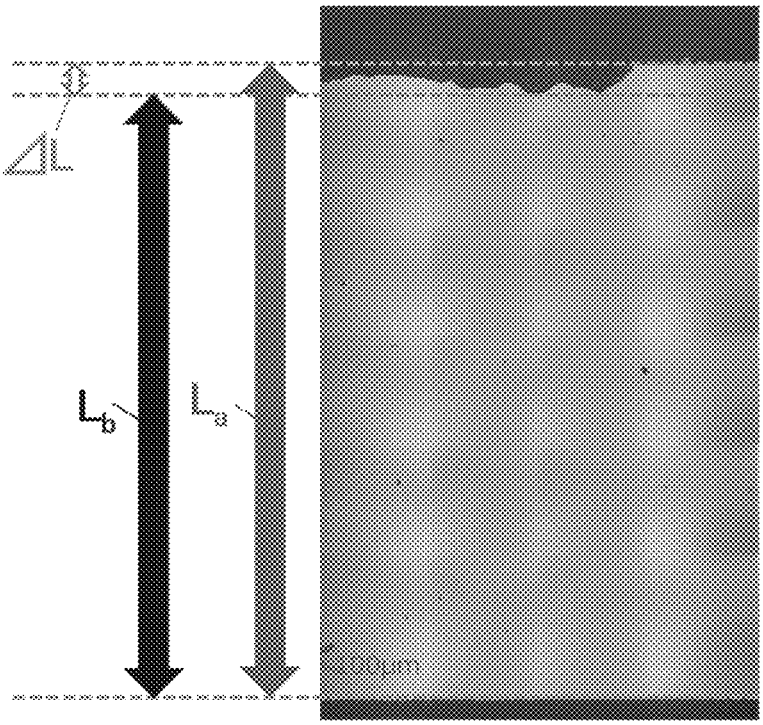
FIG. 3 is a drawing showing a method for evaluating the corrosion depth of the die material by the glass-based lubricant.

The corrosion depth was evaluated by measuring the maximum corrosion depth near the three-phase interface. The maximum corrosion depth ΔL was calculated as follows, with La as the representative value of the height of the portion of the alloy that is not affected by corrosion and oxidation in the area on which the glass-based lubricant applied from the bottom of the sample is, and Lb as the minimum value of similar heights in the corroded area near the three-phase interface. FIG. 3 shows an example of the appearance of the test specimen before and after heating and of a method for measuring the maximum corrosion depth.

Maximum corrosion depth: $\Delta L = La - Lb$

Table 6 shows the maximum corrosion depth of each test specimen calculated by the method mentioned above. In the present invention's Examples No. 4 and 5, in which the glass-based lubricant 2 was used, it can be seen that the maximum corrosion depth is smaller in No. 5, which contains Cr and Ta as the optional elements. This shows that the ingot having the composition of No. B has a higher corrosion resistance than the ingot having the composition of No. A, and that the corrosion depth is smaller when the ingot of No. B is used as a die material.

TABLE 6

| No | Maximum Corrosion Depth (μm) |
|---|---|
| 4 | 90 |
| 5 | 77 |

These results show that, according to the present invention, hot forging in air, using a Ni-based superalloy for the die, which is advantageous in terms of the service life of the die, and using a glass-based lubricant which hardly causes any chemical reaction promoting oxidative corrosion, can be performed.

The invention claimed is:

1. A method for producing a hot forged material by hot forging in which a die surface temperature is 1000° C. or more, comprising:

applying a second glass-based lubricant of a glass powder or a mixture of a powder and a dispersant onto each surface of a lower die and an upper die in contact with a material for hot forging to coat the surfaces with a lubricating film formed by the second glass-based lubricant, the lubricating film having a thickness of 100 μm or more and the glass powder comprising $SiO_2$ as a main component and further comprising $Al_2O_3$ and CaO, wherein a total content of alkali metal oxides in the glass powder is 0 to 10.0% in mass %;

heating the material for hot forging at a hot forging temperature of 1000° C. or more to provide a heated material;

placing on the lower die the heated material for hot forging, wherein part or all of a surface of the material for hot forging is coated with a first glass-based lubricant; and pressing the material for hot forging with the lower die and the upper die, to form a hot forged material, wherein one or both of the lower die and the upper die are made of a Ni-based superalloy, and wherein the Ni-based superalloy comprises, in mass %, Cr in an amount of 1.0 to 7.5%.

2. The method for producing a hot forged material according to claim 1, wherein the Ni-based superalloy has a composition comprising, in mass %, W: 7.0 to 12.0%, Mo: 4.0 to 11.0%, Al: 5.0 to 7.5%, Cr: 1.0 to 7.5%, and the balance of Ni with inevitable impurities.

3. The method for producing a hot forged material according to claim 2, wherein the composition further comprises, in mass %, Ta in an amount of 7.0% or less.

4. The method for producing a hot forged material according to claim 2, wherein the composition further comprises, in mass %, one or more elements selected from the group of Hf, Zr, La, and Y, and Mg in an amount of 0.5% or less.

5. The method for producing a hot forged material according to claim 2, wherein the composition further comprises, in mass %, Ta in an amount of 7.0% or less.

6. The method for producing a hot forged material according to claim 2, wherein the composition further comprises, in mass %, Ta in an amount of 7.0% or less and one or more elements selected from the group of Hf, Zr, La, and Y, and Mg in an amount of 0.5% or less.

7. The method for producing a hot forged material according to claim 2, wherein the composition further comprises, in mass %, one or more elements selected from the group of Hf, Zr, La, and Y, and Mg in an amount of 0.5% or less.

8. The method for producing a hot forged material according to claim 2, wherein the composition further comprises, in mass %, Ta in an amount of 7.0% or less and one or more elements selected from the group of Hf, Zr, La, and Y, and Mg in an amount of 0.5% or less.

9. The method for producing a hot forged material according to claim 2, wherein the composition consists of, in mass %, W: 7.0 to 12.0%, Mo: 4.0 to 11.0%, Al: 5.0 to 7.5%, Cr: 1.0 to 7.5%, Ta in an amount of 7.0% or less, one or more elements selected from the group of Hf, Zr, La, and Y, and Mg in an amount of 0.5% or less, and the balance of Ni with inevitable impurities.

10. The method for producing a hot forged material according to claim 1, wherein the applying step comprises spraying the second glass-based lubricant onto the surfaces of the upper and lower dies.

* * * * *